US011002118B2

(12) United States Patent
Hinton et al.

(10) Patent No.: US 11,002,118 B2
(45) Date of Patent: May 11, 2021

(54) SHAPED CHARGE AND METHOD OF MODIFYING A SHAPED CHARGE

(71) Applicant: QINETIQ LIMITED, Hampshire (GB)

(72) Inventors: Michael John Hinton, West Malling (GB); Philip Duncan Church, Bexleyheath (GB); Richard Gordon Townsley, Tonbridge (GB); Peter John Gould, Bristol (GB)

(73) Assignee: QINETIQ LIMITED, Hampshire (GB)

( * ) Notice: Subject to any disclaimer, the term of this patent is extended or adjusted under 35 U.S.C. 154(b) by 0 days.

(21) Appl. No.: 16/704,524

(22) Filed: Dec. 5, 2019

(65) Prior Publication Data

US 2020/0109615 A1 Apr. 9, 2020

Related U.S. Application Data

(63) Continuation of application No. 14/651,829, filed as application No. PCT/EP2013/076578 on Dec. 13, 2013, now Pat. No. 10,533,401.

(30) Foreign Application Priority Data

Dec. 13, 2012 (GB) ..... 1222474

(51) Int. Cl.
*E21B 43/117* (2006.01)
*F42B 1/036* (2006.01)
*F42B 1/028* (2006.01)

(52) U.S. Cl.
CPC ..... *E21B 43/117* (2013.01); *F42B 1/028* (2013.01); *F42B 1/036* (2013.01)

(58) Field of Classification Search
CPC ..... E21B 43/116–117; F42B 1/00–036
USPC ..... 89/1.15; 102/306–310; 175/4.6
See application file for complete search history.

(56) References Cited

U.S. PATENT DOCUMENTS

| | | | | | |
|---|---|---|---|---|---|
| 2,839,997 | A * | 6/1958 | Church | F42B 12/14 | 102/307 |
| 2,935,020 | A * | 5/1960 | Howard | E21B 29/02 | 102/307 |
| 3,242,987 | A * | 3/1966 | Lebourg | F42B 1/028 | 166/297 |
| 3,371,605 | A * | 3/1968 | Eckels | F42B 1/02 | 102/331 |
| 3,726,224 | A * | 4/1973 | Pugh | F42B 1/028 | 102/476 |
| 3,732,818 | A * | 5/1973 | Thomanek | F42B 1/028 | 102/306 |
| 4,841,864 | A * | 6/1989 | Grace | F42B 1/02 | 102/307 |
| 6,026,750 | A * | 2/2000 | Nelson | F42B 1/02 | 102/307 |
| 7,600,476 | B1 * | 10/2009 | Baker | F42B 1/028 | 102/306 |
| 2011/0232519 | A1 * | 9/2011 | Sagebiel | F42B 1/028 | 102/309 |

(Continued)

*Primary Examiner* — Stephen Johnson
*Assistant Examiner* — Benjamin S Gomberg
(74) *Attorney, Agent, or Firm* — Kenealy Vaidya LLP

(57) ABSTRACT

Some embodiments are directed to a shaped charge liner including an apex end and a base end and defining a main liner axis that passes through the apex and base ends, the liner being rotationally symmetric about the main liner axis wherein the liner has discrete rotational symmetry about the main liner axis.

10 Claims, 18 Drawing Sheets

(56) References Cited

U.S. PATENT DOCUMENTS

2011/0239888 A1* 10/2011 Waddell ..... F42B 1/032
102/307

* cited by examiner

| LINER TYPE | ROCK TYPE | HOLE TYPE | |
|---|---|---|---|
| | | CROSS-SECTION | PENETRATION (INTO ROCK) |
| A | R1 | SLOT | 15mm |
| | R2 | SLOT | 25mm |
| | R3 | SLOT | 10mm |
| | R4 | SLOT | 5mm |
| B | R1 | ELLIPTICAL | 25mm |
| | R2 | ELLIPTICAL | 15mm |
| | R3 | ELLIPTICAL | 10mm |
| | R4 | ELLIPTICAL | 5mm |
| c | — | — | — |
| | — | — | — |
| | — | — | — |
| | — | — | — |
| d | | | |

Figure 17

SHAPED CHARGE AND METHOD OF MODIFYING A SHAPED CHARGE

This application claims priority to and is a continuation of U.S. application Ser. No. 14/651,829 filed Jun. 12, 2015, which is a National Phase filing under 35 C.F.R. § 371 of and claims priority to PCT Patent Application No. PCT/EP2013/076578, filed on Dec. 13, 2013, which claims the priority benefit under 35 U.S.C. § 119 of British Patent Application No. 1222474.7 filed on Dec. 13, 2012, the contents of each of which are hereby incorporated in their entireties by reference.

FIELD OF THE INVENTION

The present invention relates to a shaped charge liner, a shaped charge and a method of modifying a shaped charge. In particular, the present invention relates to the use of shaped charge liners and shaped charges within an oil and gas extraction environment. In addition to the oil/gas environment, the present invention may have other applications such as in water/steam boreholes for power generation, for example, and also to enhance the performance of bore holes to release drinking water.

BACKGROUND TO THE INVENTION

Fracturing is an important process during the formation of some oil and gas wells, referred to as unconventional wells, to stimulate the flow of oil or gas from a rock formation.

Typically a borehole is drilled into the rock formation and lined with a casing. The outside of the casing may be filled with cement. The main purpose of the casing is to prevent the borehole from collapsing under the significant hydrostatic loading due to the rock above.

It is not uncommon for boreholes to be several kilometres deep and they can be vertical as well as having horizontal paths depending on the rock strata and the application they are being used for.

The borehole casing is typically much smaller than the bore hole (for a 0.23-0.25 metre diameter bore hole, the external diameter of the casing might be 0.15-0.18 metres). The annulus between the casing and the bore hole is filled with cement which is pumped in from a pipe that is lowered to the bottom of the well and thereby feeds cement into the annulus so that it flows up the side of the casing to the surface. The casing serves two crucial purposes: (i) given that a well might be 5-10 kilometres underground, the cementation layer acts as a 'glue' between the casing and the rock so that the weight of the casing is carried by the rock (if the load isn't transferred to the rock then essentially you would be left with a 10 km long pipe hung from the surface. Under such loading conditions the casing would more than likely fail); (ii) the cementation layer acts as a seal to isolate each individual perforation track and to prevent any oil or gas from passing through the annulus and out of the well. It is noted that the Gulf of Mexico disaster was a result of the cementation layer failing (referred to as a well blow out). In that situation, the fluid is flowing out through the annulus and because it isn't flowing up through the casing, there will be no valves or control of any sort possible.

In unconventional wells the rock formation may require fracturing in order to stimulate the flow. Typically this is achieved by a two-stage process of perforation followed by hydraulic fracturing. Perforation involves firing a series of perforation charges, i.e. shaped charges, from within the casing that create perforations through the casing and cement that extend into the rock formation.

Once perforation is complete the rock is fractured by pumping a customised fluid, which is usually water based containing a variety of chemicals (often strong acids), down the well under high pressure. This fluid is therefore forced into the perforations and, when sufficient pressure is reached, causes fracturing of the rock.

A solid particulate, such as sand, is typically added to the fluid to lodge in the fissures that are formed and keep them open. Such a solid particulate is referred to as proppant.

The well may be perforated in a series of sections. Thus when a section of well has been perforated it may be blocked off by a blanking plug whilst the next section of well is perforated and fractured.

An example of a known perforator design is shown in FIG. 1. The perforator 10 comprises a generally cylindrical charge case 20 within which is mounted a shaped charge liner 30. The charge case is retained by an initiator holder 40 at a first end and is open at a second end 50.

The liner is generally conical in shape such that a volume is defined between the charge case and the liner which is filled with an explosive composition 60. In the oil and gas industry this composition typically comprises a variety of HMX based compositions in pressed powder form.

The liner 30 is placed within a charge case, which is filled with the main explosive. An initiator system is placed at the first end of the charge case, the initiator system being contained within the initiator holder. At the second end 50 of the charge case the base of the liner is open and is oriented in a radially outward direction when in use, facing the casing. In operation, the initiator system is operable to detonate the explosive composition which causes the liner material to collapse and be ejected from the charge case in the form of a high velocity jet of material. The jet breaches the wall of the perforator gun (see below) and the well casing, and then penetrates into the cementation layer and the rock, thereby causing a hole (a perforation tunnel) to form. The perforation tunnel provides the path between the well bore and the rock for fluid flow (i.e. either for hydraulic fracking or for oil/gas extraction).

It is noted that the liner shape can be chosen to suit the rock strata and application.

Liners can be conical or hemispherical in general, conical liners typically giving more penetration than hemispherical liners, although there are variants on these shapes (e.g. tapered liners). The casing of the perforator is conventionally steel although other materials (such as brass and polymers) can be used depending on the particular application.

The shape of charge liners has been explored to some extent in the military and civil fields. For example, GB 1465259 discloses an explosive charge formed with a recess which is lined with a metal casing consisting of a plurality of triangular walls, wherein the mouth of the recess takes the shape of a plane polygon. The charge generates a very large number of high velocity splinters propelled in a given solid angle, and the thrust of the embodiments appears to be towards splinter dispersion rather than shaped charge effects. US 2011/0232519 discloses a shaped charge for use as a cutting tool which may have a polygonal shape. However, the liner has a recess in the form of a groove encircling an axis of symmetry so as to provide a cut pattern which is a polygonal pyramid, and is quite different to directional charges for fracking purposes.

Perforators may be arranged into a perforator gun which comprises a detonation cord which has perforator charges mounted thereon. The particular configuration within the gun is again dependent on the application. This can range from a helical arrangement with many thousands of charges along the gun at 13-20 spacing per metre over many tens of metres or hundreds of metres to other configurations where there is a sparse distribution of charges over 50 metres or so.

An example of a perforator gun is shown in FIG. 2 which shows a borehole 70 projecting through a rock formation 80. The rock comprises a number of bedding planes 90. Within the borehole is a metal casing 100 and the volume between the casing and the borehole has been filled with cement 110. A perforator gun 120 comprising a detonator cord 130 (and associated control circuitry) and a plurality of perforators 140 is located within the body of the perforating gun. Once detonated a perforator will eject a jet of material to form a hole (a 'perforation tunnel' located, for example, at 150) through the wall of the perforating gun, the well casing and the cementation layer into the rock formation.

The fracturing process is a key step in unconventional well formation and it is the fracturing process that effectively determines the efficiency of the well. The pressure, the amount of fluid and proppant and the flow rate are generally measured to help manage the fracturing process, including the identification of any potential problems (e.g. seal/plug failures). The down-hole temperature is likely to be in the region of 80-120° C., but can be as high as 170° C.

Rock formations that contain oil and gas deposits generally comprise rock strata that have aligned to form a number of bedding planes. Examples of such rock formations include oil/gas bearing shales in, for example, Canada, Dakota etc and oil/gas bearing tight rock formations in, for example, the North Sea.

Detonation of a perforator within the oil well will generally result in fractures appearing within the rock formation. The bedding planes represent a plane of least resistance for the growth of such fractures which may typically extend out from the bore hole by 50 metres.

If oil and gas deposits are situated such that they intersect a bedding plane then detonation of a standard perforator will enable the oil/gas to be extracted. However, in some instances the oil/gas deposits may be situated between bedding planes. In order to access these such deposits it would be preferable to have more control over the direction that fractures propagate in and, in particular, to be able to generate "out of bedding plane" fractures by means of the perforator gun.

It is noted that there are three general categories of well bore orientation: Where the well bore is orthogonal to the bedding planes (called a 'vertical well') Where the well bore is parallel to the bedding planes (called a 'horizontal well') Where the well bore runs at an angle across the bedding planes (called a 'slant well') (Note that the vertical and horizontal designations above relate to the bedding planes NOT the true geospatial coordinates.)

Known methods of encouraging out of plane fracture propagation include: increasing the pressure of the fluid that is pumped into the hole and including chemicals in the fluid that etch the rock in an effort to produce out of plane cracking. These techniques work well for some rocks and bedding plane configurations, but can be problematic for certain other environments (e.g. such as those in some tight gas wells).

It is therefore an object of the present invention to provide a shaped charge arrangement that facilitates preferential crack formation, growth and orientation in the rock strata.

SUMMARY OF THE INVENTION

According to a first aspect of the present invention there is provided a shaped charge liner comprising an apex end and a base end and defining a main liner axis that passes through the apex and base ends, the liner being rotationally symmetric about the main liner axis wherein the liner has discrete rotational symmetry about the main liner axis.

The present invention provides for a shaped charge liner that may, for example, be used in an oil/gas well perforator, in which the liner is not circularly symmetric as is commonly found in shaped charges (e.g. conical or hemispherical liners) but instead demonstrates discrete rotational symmetry. Such liner configurations may advantageously be able to provide directed or shaped jets that have improved penetration characteristics compared with known liner configurations. The invention has particular application to the facilitation of preferential crack formation in hydraulic fracking.

It is noted that the liner as a whole may demonstrate discrete rotational symmetry about the main liner axis. However, a shaped charge liner defines an internal cavity and it may be the walls of the cavity that demonstrate discrete rotational symmetry.

The liner may be pyramidal in shape. In an alternative arrangement, the cross section of the liner in a plane perpendicular to the main liner axis may have a star-shaped cross section. For example, the cross section may be a four pointed star or a five pointed star.

In a further alternative, the liner may be generally prismatic in shape. Each end of the prism may comprise a half cone shape.

By way of clarification, the liner defines an enclosed space having an apex which is open at the base end.

The liner may be formed from a wrought metal. For example, the liner may be formed from copper. As an alternative, the liner may be formed from a pressed metal powder. The metal powder may comprise tungsten powder, copper powder or any other suitable metal powder. The metal powder may comprise one metal or a combination of metals.

The wrought metal or metal powder may also comprise a metal alloy, for example a copper alloy. Preferably, the liner comprises a metal powder and the metal powder is selected so as to provide a desired perforation geometry.

The liner may comprise a reactive liner. For example, the liner may comprise a pressed powder mixture of reactive metals such as Ni and Al, optionally with at least one further inert metal. Other reactive mixtures are known in the prior art.

The skilled person will realise that liner composition may comprise one or more other components, such as, for example, a binder material.

The apex end of the liner may define an internal apex angle. In one variant of the shaped charge liner, the angle may be substantially 50 degrees. In another variant of the shaped charge liner, the angle may be substantially 60 degrees.

According to a second aspect of the present invention there is provided a shaped charge liner comprising an apex end and a base end and defining a main liner axis that passes through the apex and base ends, the liner defining a prismatoid cavity.

A prismatoid is a polyhedron where all vertices lie in two parallel planes. Examples of prismatoids include pyramids, where one plane contains only a single point and wedges, where one plane contains only two points. A prismatoid may also define shapes such as stars in one of the planes. Such stars could be regular, e.g. a pointed star where the points form a symmetrical arrangement. Alternatively, the stars could be irregular, e.g. one or more of the points could be missing, truncated and/or "misplaced".

The liner may comprise an outer surface and an inner surface, the prismatoid cavity being defined by the inner surface. The outer surface may define a prismatoid. The outer surface and inner surfaces may define different shapes (for example, the internal surface [the cavity] may define a prismatoid whereas the outer surface of the liner may define a cone or hemisphere or any other shape).

According to a third aspect of the present invention there is provided a shaped charge perforator for perforating an oil/gas well and forming a hole in surrounding rock comprising a liner according to the first aspect of the invention, a casing within which the liner is received and a quantity of high explosive positioned between the liner and the casing. The shaped charge perforator may also comprise an initiator.

The casing may be open at one end and the open end may be rotationally or may be circularly symmetric. It is noted that changing the shape of the casing may change the loading on the liner through the effects of reflected shock. This in turn may affect jet shape. Alternative casing shapes may be used, e.g. a star shaped casing.

The shaped charge perforator can be configured to produce a focussed energy profile in the rock strata to enhance and control the general fracture process within the rock. A shaped charge perforator suitable for use in the oil and gas industry generally has a small calibre, particularly when compared with military charges. It will be understood that the calibre of the shaped charge perforator (more usually referred to as the calibre of the liner) may be chosen to suit the well conditions. However, perforator liners for downwell use typically have a base diameter of 100 mm or less, more preferably 80 mm or less and even more preferably 50 mm or less. The perforator liner may have may have a diameter in the range 10 mm to 100 mm, more preferably in the range 20-80 mm, and even more preferably in the range 30-50 mm.

The invention extends to a perforator gun comprising one or more shaped charge perforators according to the third aspect of the present invention.

The invention also extends to a method of completing an oil or gas well comprising the step of providing one or more perforators as described above, or a perforator gun comprising one or more shaped charge perforators.

Preferably, the method of completing an oil or gas well comprises the additional step of perforating a well casing, thereby forming one or more perforations which connect the well bore and the formation. The well casing is perforated by activating or detonating the one or more perforators.

The method of the invention is particularly applicable to f racking applications. Accordingly, the method may comprise the further step of inducing out of plane fracture propagation of the one or more perforations after the perforating step. Out of plane fracture may be induced by any suitable physical, mechanical and/or chemical technique, preferred techniques being:

(i) pumping a hydraulic fluid into the one or more perforations so as to increase the pressure thereof; and/or (ii) pumping an etching fluid into the one or more perforations so as to chemically etch the rock.

A single pumped fluid may combine hydraulic and etch properties.

The invention also extends to the use of a perforator as described above, comprising one or more shaped charged perforators, in the completion of an oil or gas well.

According to a fourth aspect of the present invention there is provided a method of optimising a shaped charge liner design for use in an oil/gas well perforator in order to form a desired hole shape in a rock formation, the method comprising comparing the desired hole shape to a library of known liner designs, the library comprising data relating to the hole shape formed by each liner design within the library;

selecting the liner design that produces the closest hole shape to the desired hole shape; varying at least one parameter of the selected liner design to form a modified liner design;

modelling the hole shape that the modified liner design produces;

repeating the varying and modelling steps until the hole shape of the modified liner design converges towards the desired hole shape.

The varying step may comprise varying the thickness of the selected liner design. The selected shaped charge liner design may define an internal apex angle and the varying step may comprise varying the internal apex angle of the selected liner design.

The varying step may comprise varying the liner material of the selected liner design.

Multiple parameters of the selected liner design may be varied. In one variant, the multiple parameters may be varied in parallel or may be varied sequentially.

The library may comprise data for a plurality of liner designs and the hole shape each liner produces in a range of different rock strata. The selecting step may comprise filtering the data for the plurality of liner designs against the rock conditions for a particular well environment.

According to a fifth aspect of the present invention, there is provided a method of generating a library of shaped charge liners detailing the performance of such liners in different environmental conditions, the method comprising: receiving desired hole target parameters; receiving data relating to the environmental conditions that the shaped charge liner is to be operated under; modelling bespoke shaped charge liner; determining the hole parameters that such a bespoke liner creates in relation to the environmental conditions and adding data relating to the shaped charge liner and its performance to a library.

The invention also extends to a computer readable medium comprising a computer program arranged to configure a computer to implement the method according to the second, third, fourth or fifth aspects of the invention.

It is noted that preferred features of aspects of the present invention may be applied to other aspects of the present invention.

BRIEF DESCRIPTION OF THE DRAWINGS

Embodiments of the present invention will now be described, by way of example only, with reference to the accompanying drawings, in which like reference numerals are used for like parts, and in which:

FIG. 17 shows an example of the data contained in the library of FIGS. 16*a* and 16*b*.

DETAILED DESCRIPTION OF THE INVENTION

In accordance with aspects of the present invention it is noted that improved fracture formation and also preferential directionality of fracture propagation may be achieved by the use of non-circularly symmetric shaped charge liners within the oil/gas perforators used in a down-hole oil/gas well.

Such non-circularly symmetric liners—optionally with and non-circularly symmetric cases—result in the creation of a collapse jet with tuneable, non circular characteristics. This in turn leads to the deliberate creation of non-circular holes (perforation tunnels) in the rock formation, thereby establishing near-bore tunnel geometries and residual stress states that allow greater control over fracture initiation and propagation orientation towards the far field (i.e. at distance from the well-bore rock formation).

The essence of the invention is that the completion engineer can choose the best bespoke charge option to produce the preferred fracture pattern in the rock using the 'designer hole' concept, optimised for a given rock strata and borehole well dimensions. Thus it is entirely possible that different charge options would be used for different types/size of boreholes and different rock strata environments. This would empower the completion engineer to make informed decisions as to which charge design is best suited to the situation in that borehole/well configuration.

The figures detail an example where the concept has been demonstrated in principle to produce a slot shaped hole in a specific well casing configuration. The results of simulations and laboratory proof tests of such liners are detailed (in conjunction with FIGS. 3 and 7 to 15 *a-d*) for a well and bore hole with the following parameters: Metal casing liner internal diameter (ID)=9.96 cm, outer diameter (OD)=11.43 cm, borehole size 20.24 cm.

Figure 1:
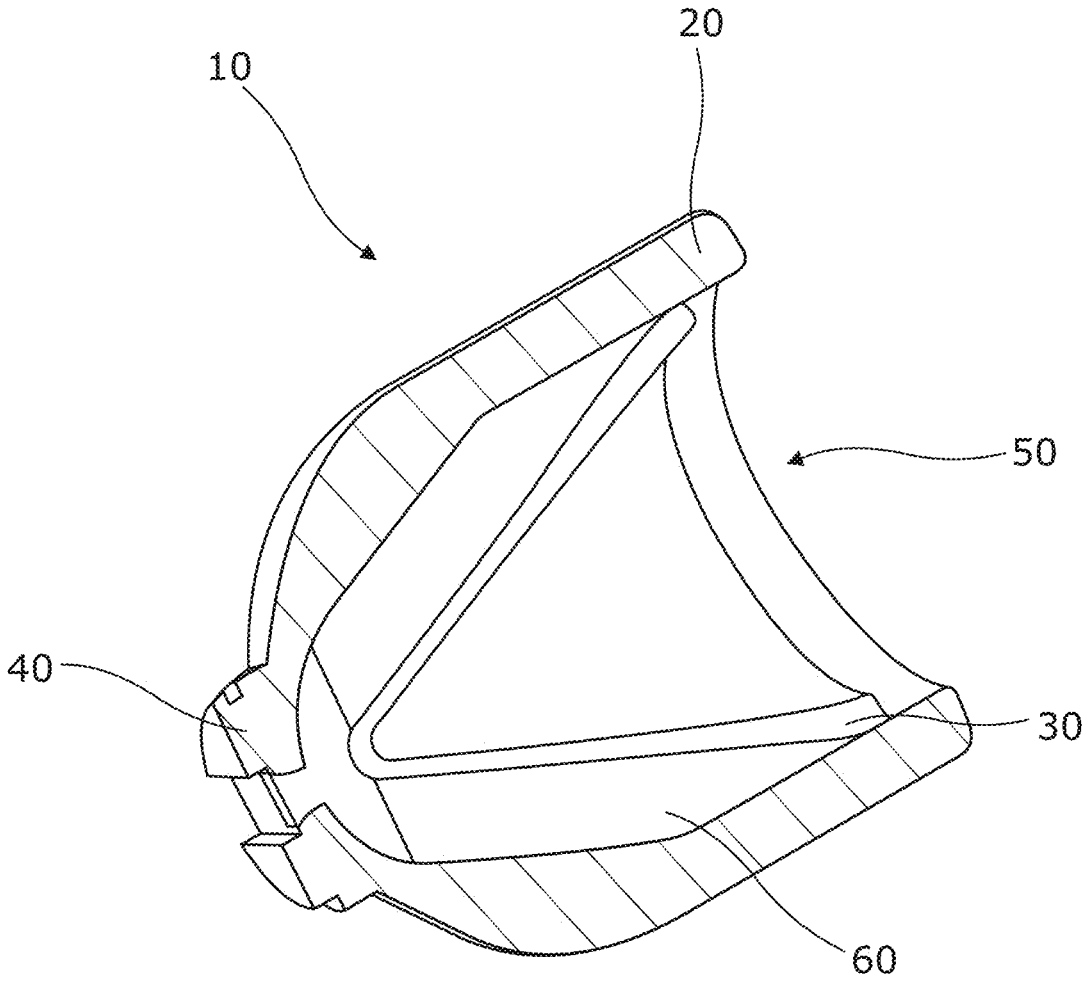
FIG. 1 shows a known perforator design.
Figure 2:
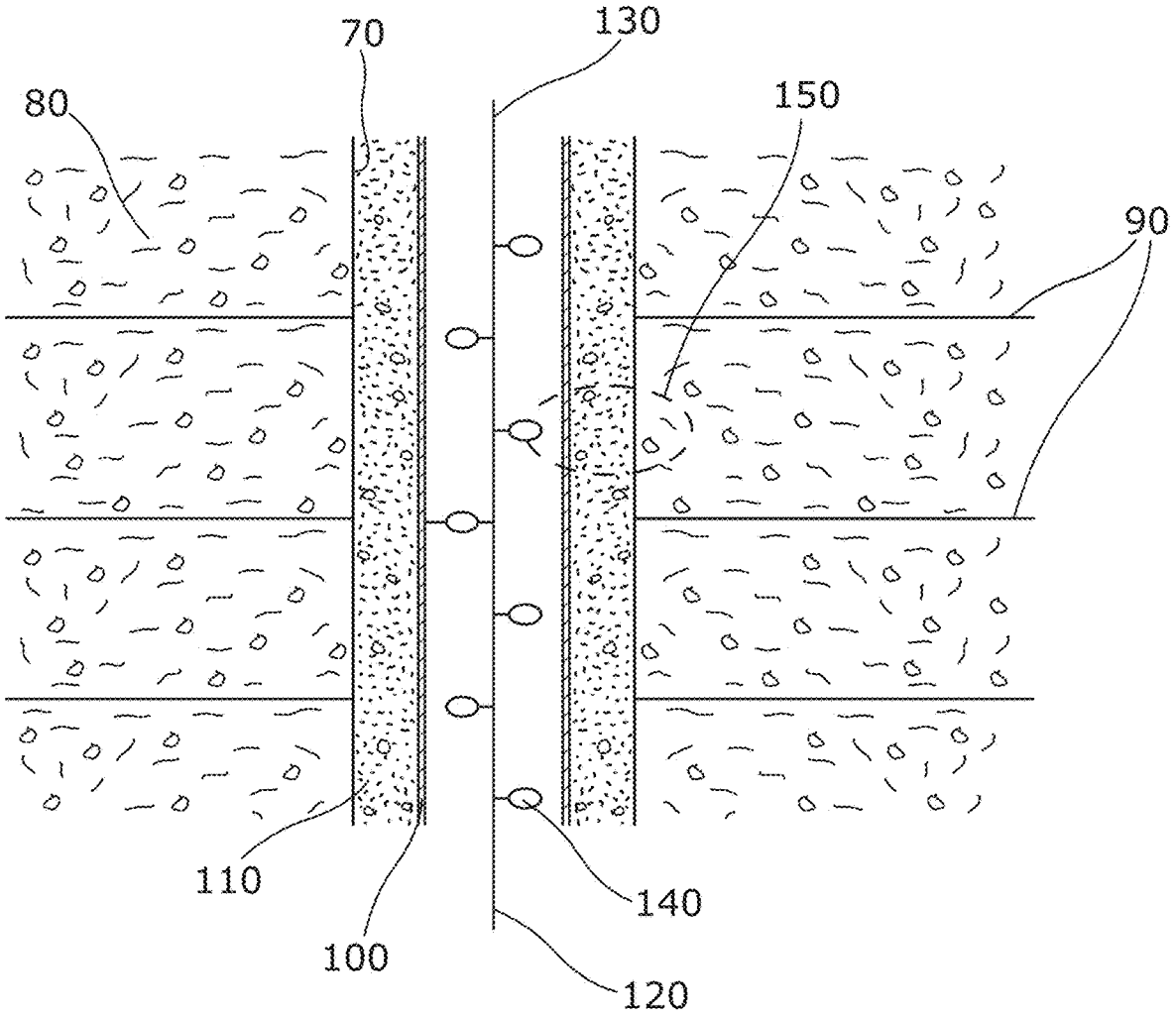
FIG. 2 shows a representation of a well bore and perforator gun.

It is noted that the perforating gun used to deploy the perforating charges (depicted in FIGS. 4 to 6) down-well has to fit readily within the well casing (see FIG. 2). The maximum gun diameter is therefore in the region of 90 mm for this case, which gives a stand-off distance between the shaped charge liner and the well casing of less than 10 mm. In fact it is noted that the perforators will sit within a carrier inside the perforator gun. The wall of the perforating gun is usually scalloped internally (counter-bored) and the perforators are aligned with the scallop pocket to minimise the thickness of gun body that the perforator jet must pass through. The standoff between the perforator and the inside surface of the perforating gun is likely to be of the order of a few mm (since the apex of the perforator body is sitting on the scallop pocket).

It is important to note that in order to avoid fracturing or splitting the perforating gun as a result of firing the perforators, it is essential to ensure that the gun can be withdrawn readily from the well. Furthermore, for reasons of well operational integrity, it is essential to avoid the destruction or failure of any interstitial seals between various sections of the well bore when the perforator gun is fired. There is therefore a trade-off between the net explosive size (NEQ) of the perforator and the integrity of the well casing and well case integrity.

Figure 3:
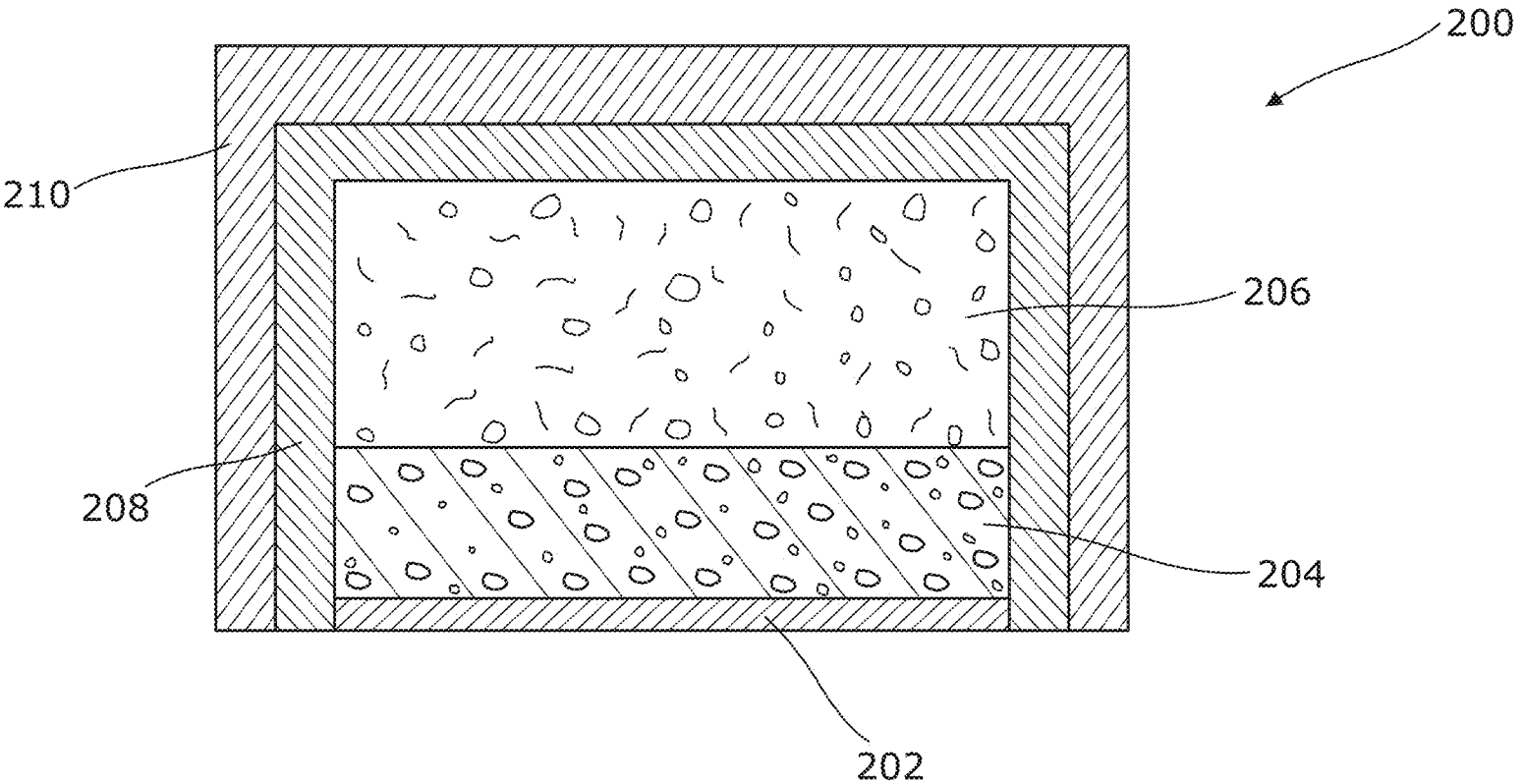
FIG. 3 shows an array used in firing trials that mimics a down well environment.

FIG. 3 shows a target 200 which was used in proof of principle laboratory firing trials to evaluate the shaped charge liners in accordance with embodiments of the present invention. The target was designed to mimic the down-hole arrangement of liner casing, cement and rock. Consequently, a thin front plate 202 having a diameter of 500 mm was arranged above a block of cement 204 backed by rock 206.

Byro sandstone was identified as having a density and porosity similar to the rock conditions in a typical well. Byro rock was regarded as representative of the strength of the rock strata in the down well condition. The target was encased in a concrete 208 and steel box 210 to contain any cement and rock to prevent the target from shattering and to contain any localised fractures and thereby facilitate post-firing examination and measurement.

Three geometric configurations of shaped charge liner were investigated, both theoretically and experimentally (against the target shown in FIG. 3). In each instance identical, initiation, liner casing and explosive elements were used (i.e. the liner geometry was the single variable). These liners are shown in FIGS. 4 to 6.

Figure 4:
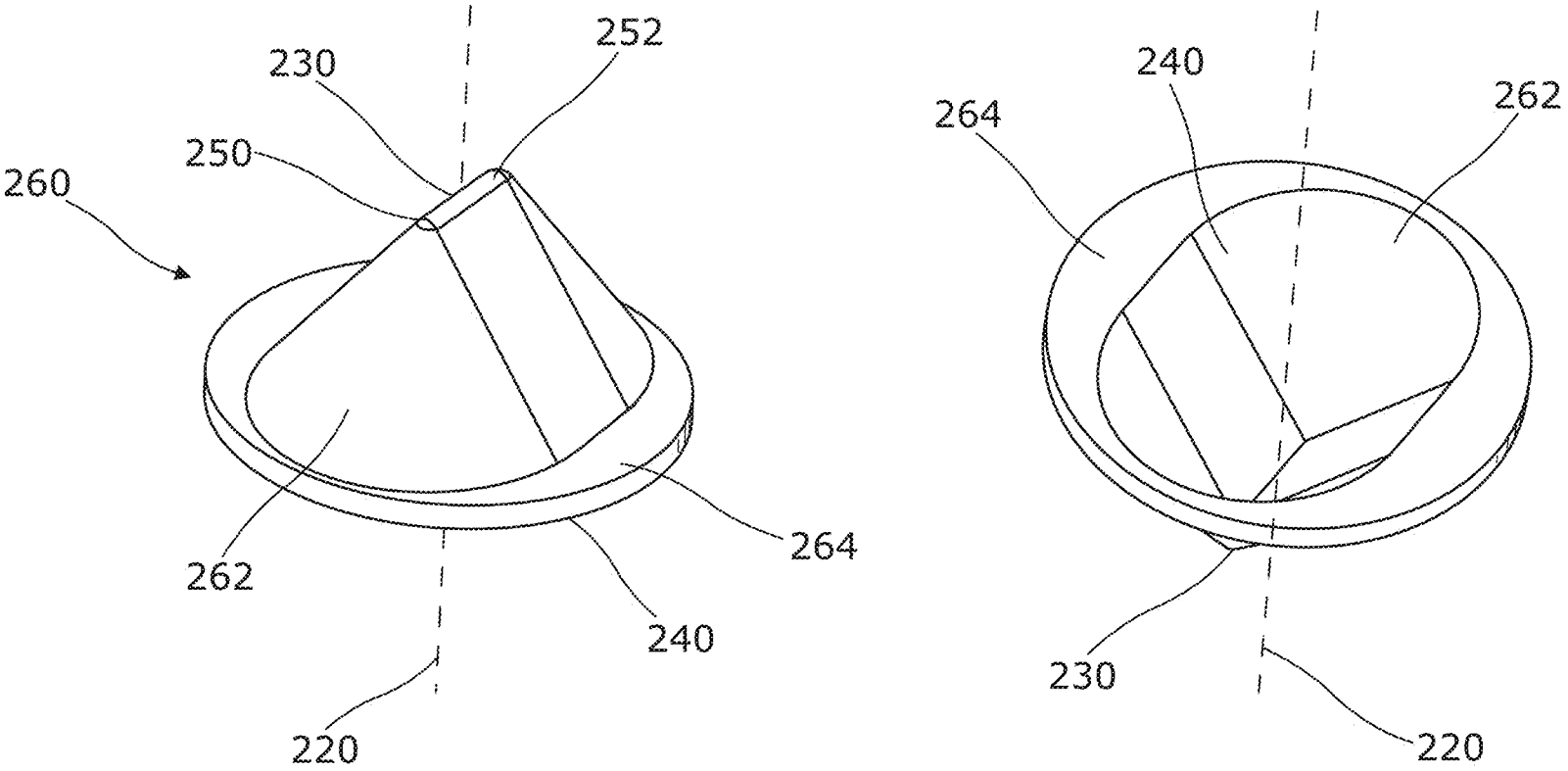
FIGS. 4 to 6 show examples of shaped charge liners in accordance with embodiments of the present invention.
Figure 5:
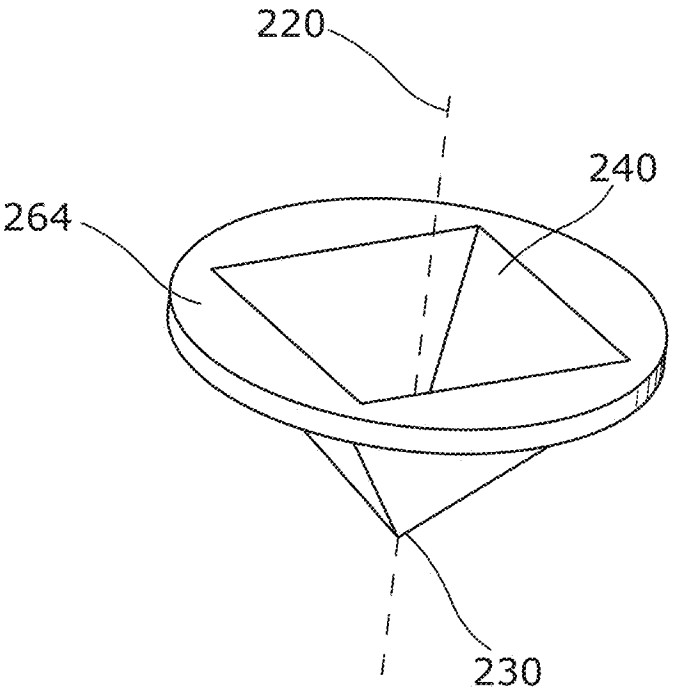
Figure 5:
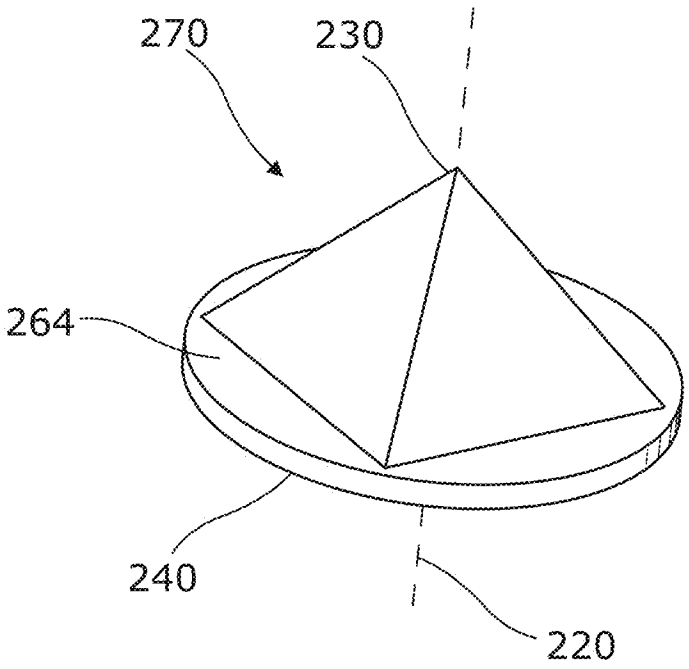
Figure 6:
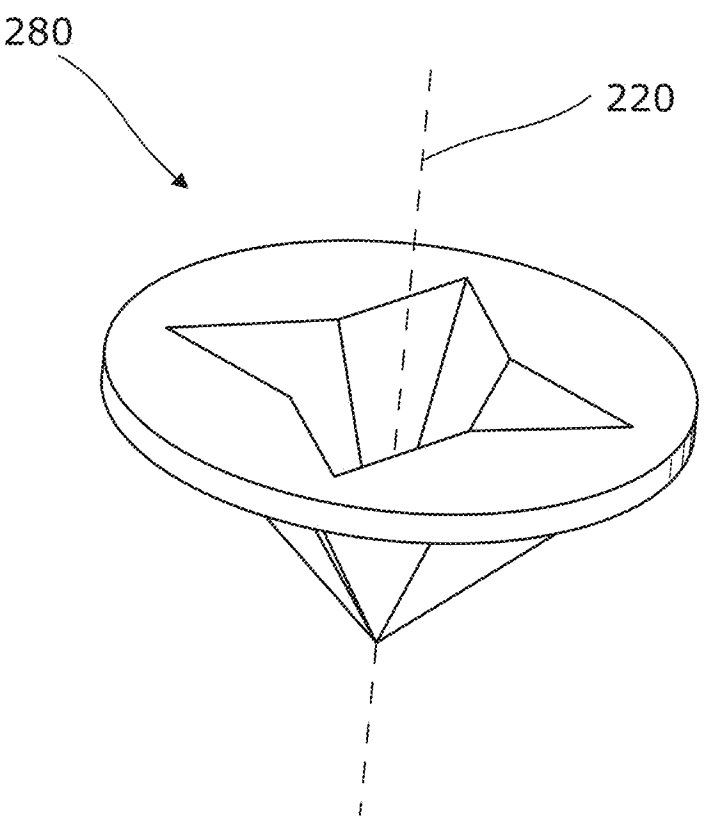
Figure 6:
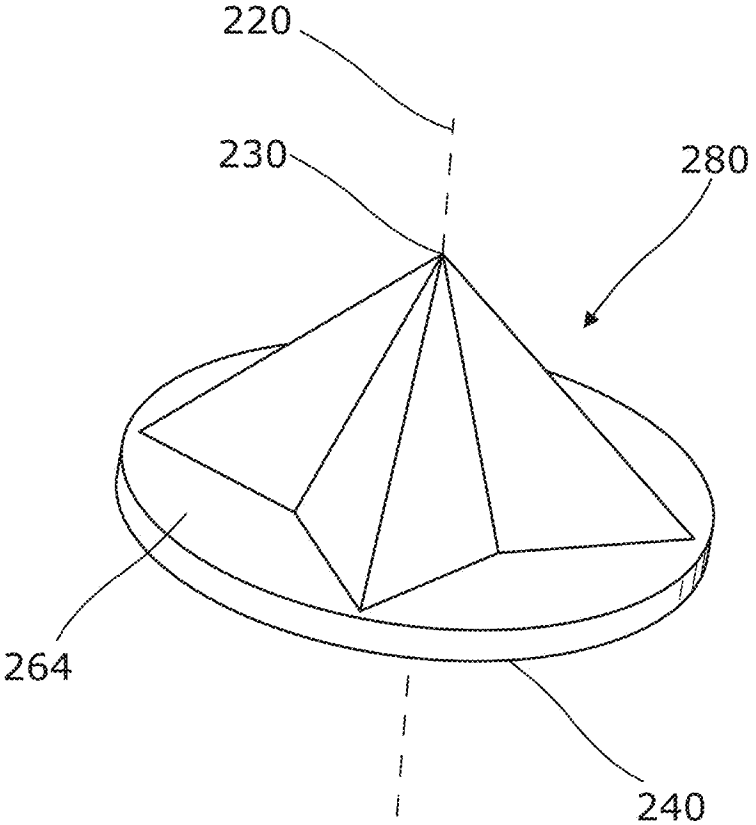

For each of the shaped charge liners depicted in FIGS. 4 to 6 a main liner axis 220 is shown that passes through both the apex 230 and base 240 of the liner in question. Note: although the discussion below is in the context of a liner axis it will be appreciated by the skilled person that the shaped charge liner may comprise a planar axis that passes through both the apex and base of the liner in question. The term liner axis should therefore be read accordingly. In relation to this point see for example FIG. 4 where the axis 220 is actually a planar axis that passes through the line defined by points 250 and 252.

FIG. 4 shows a generally prismatic liner shape 260 in which the ends of the prism have been formed into a "half cone" shape 262. The base end of the shaped charge liner is formed into a lip member 264 which has a circular profile for convenient engagement with the perforator charge casing. The apex 230 of the liner of FIG. 4 is a line rather than a point. It is noted that looking down the main liner axis 220 (from above the apex 230 end of the liner) it can be seen that the liner of FIG. 4 demonstrates rotational symmetry (such that a 180° rotation, 2-fold symmetry will leave the liner unchanged) but does not demonstrate circular symmetry. In other words any angular rotation of the liner of FIG. 4, other than 180° or a multiple thereof, will not result in the liner appearing identical to the start position.

FIG. 5 shows a pyramidal shaped charge liner 270. Again the base 240 of the liner is formed into a lip member 264.

Again, viewed from above the liner demonstrates rotational symmetry (4-fold rotational symmetry) but does not display circular symmetry.

FIG. 6 shows a shaped charge liner 280 that has a star-like cross section. The particular liner depicted in FIG. 5 is a four pointed star but it is noted that the liner may be constructed as a five pointed, six pointed or an n-pointed star (where n is an integer). The base 240 of the shaped charge liner is formed into a similar lip member 264 to that of FIG. 4. Again, viewed from above the liner demonstrates rotational symmetry (4-fold rotational symmetry) but does not display circular symmetry.

The liners (260, 270, 280) depicted in FIGS. 4 to 6 are therefore distinguished from known conical or hemispherical liners which exhibit circular symmetry.

Figure 7:
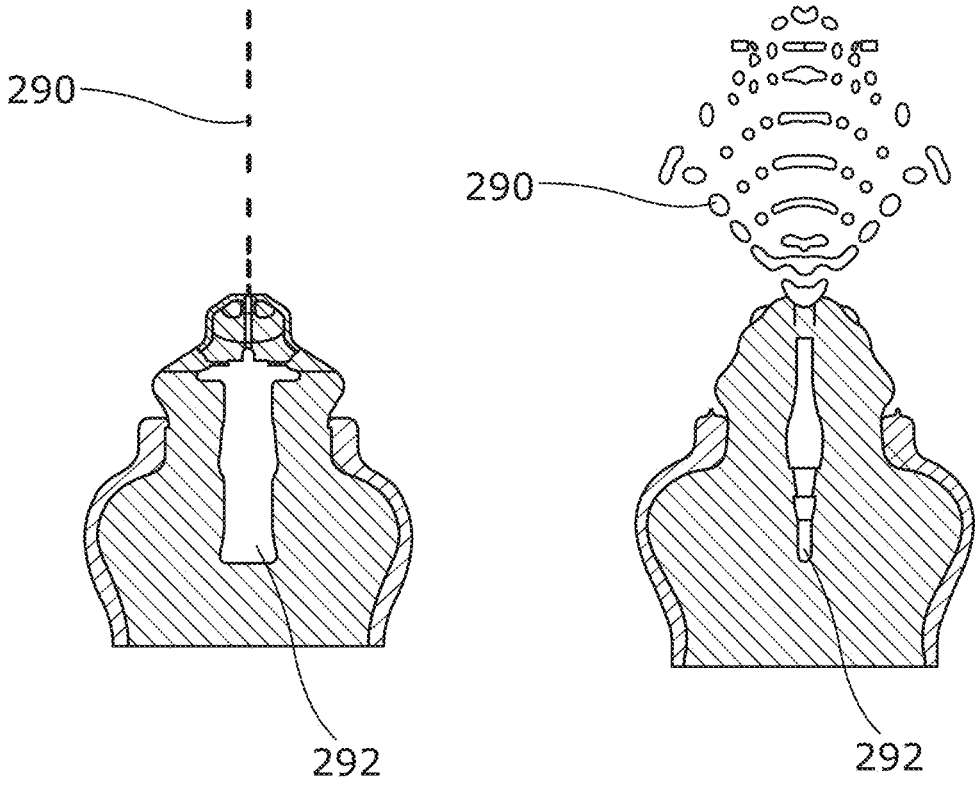
FIG. 7 shows a simulation of the shaped charge liner depicted in FIG. 4.

FIG. 7 shows a simulation of the shaped charge liner 260 of FIG. 4 when fired from a perforator gun. It can be seen that the jet 290 of ejected material is dispersed into distinctive planes (the left hand and right hand images in FIG. 7 show two perpendicular planes). It is also noted that the rear of the jet (the "slug" 292) is rectangular in shape.

Figure 8:
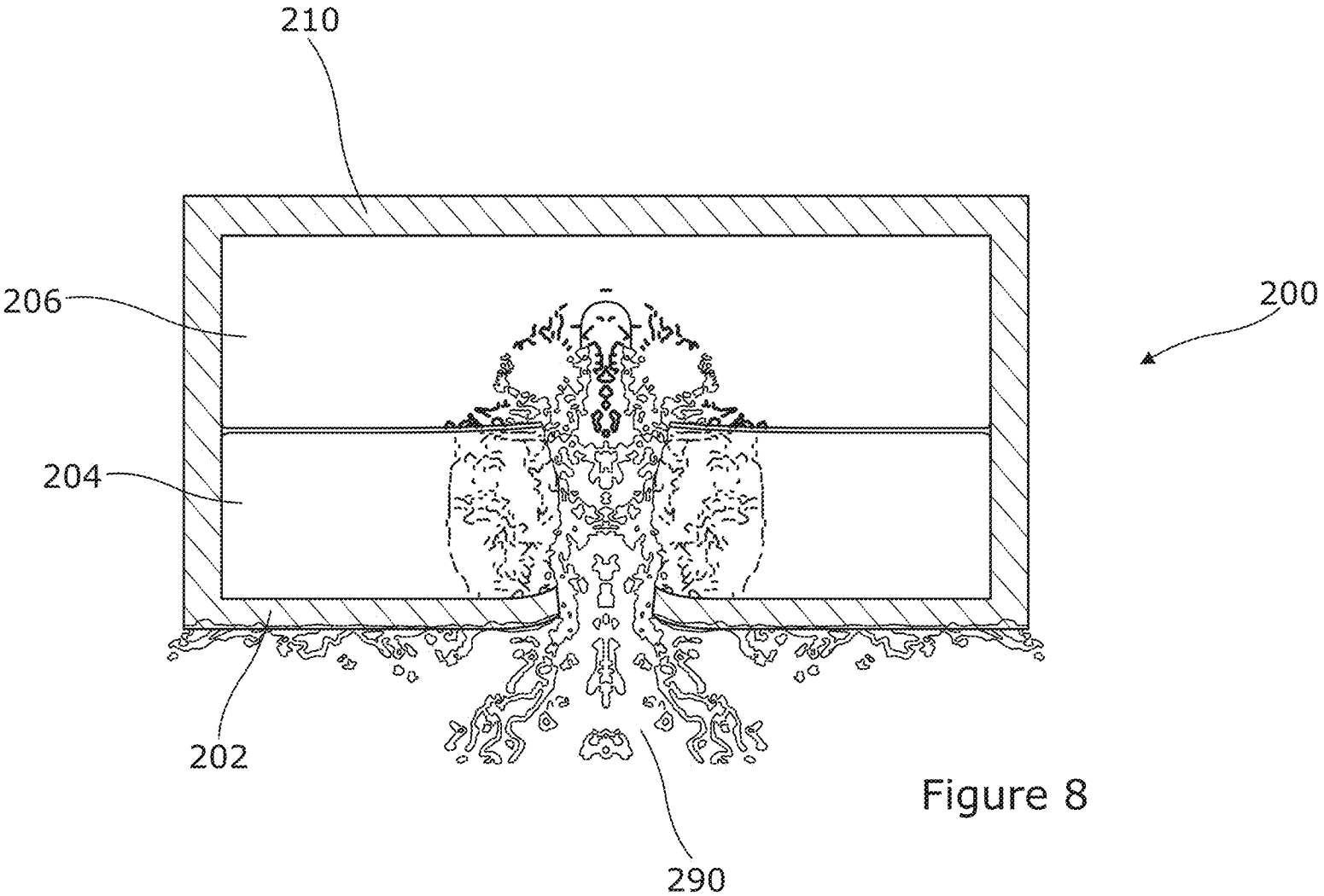
FIG. 8 shows the simulated effects of the jet of FIG. 7 impacting the array of FIG. 3.

FIG. 8 shows the simulated effects of the jet 290 of FIG. 7 impacting the target arrangement 200 of FIG. 3. It can be seen that the jet 290 is predicted to penetrate through the well casing 202, the cement 204 and into the rock 206. It is noted that FIGS. 7 and 8 represent a shaped charge liner in accordance with FIG. 4. In this case the liner was fabricated from wrought copper but could also be pressed powder or even non-metallic or reactive.

Figures 9A, 9B, 9C, 9D:
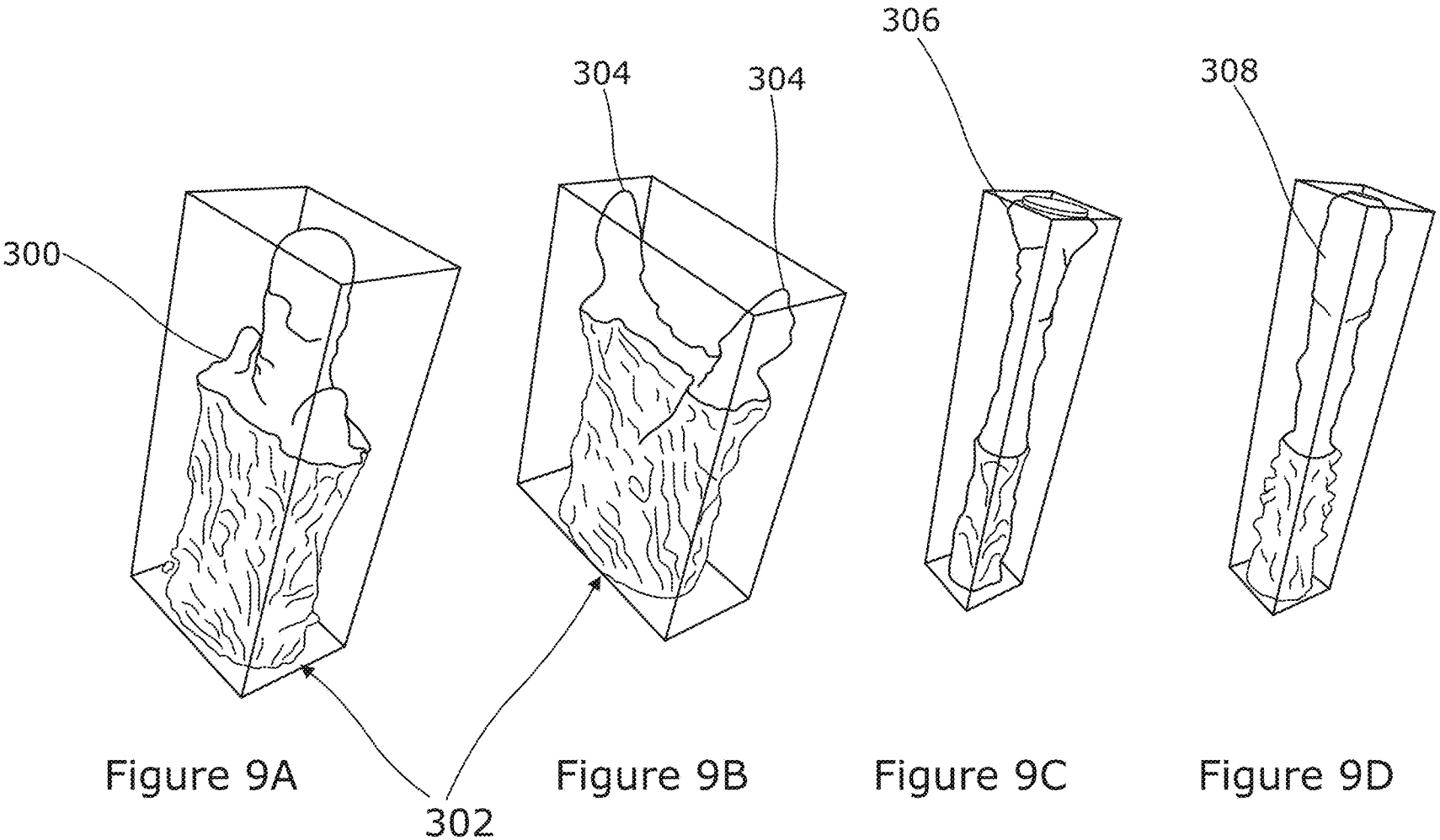
FIGS. 9*a* to 9*d* show predicted tunnel geometries for the liners depicted in FIGS. 4 to 6.

FIG. 9*a* is a three dimensional representation of the predicted tunnel geometry 300 formed by the jet 290 of FIG. 7 (liner 260 of FIG. 4). It can be seen that the hole 302 in the backing rock is generally slot shaped (i.e. it has a rectilinear geometry). It is also noted that the hole in the well casing is also slot shaped FIG. 9*b* shows the predicted tunnel geometry formed for a liner of FIG. 4 fabricated from tungsten powder. It can be seen that the hole of FIG. 9*b* is also slotted in shape but additionally has two offshoots 304 from the main hole 302 such that the overall jet shape is generally "Y" shaped. The two offshoots provide a mechanism for producing preferential fracture initiation sites in the rock formation.

FIGS. 9*c* and 9*d* show the tunnels that result from copper liners according to FIGS. 6 and 5 respectively. The tunnel 306 formed in FIG. 9*c* can be seen to be generally diamond shaped and the tunnel 308 formed in FIG. 9*d* can be seen to be generally elliptically shaped.

Figure 10:
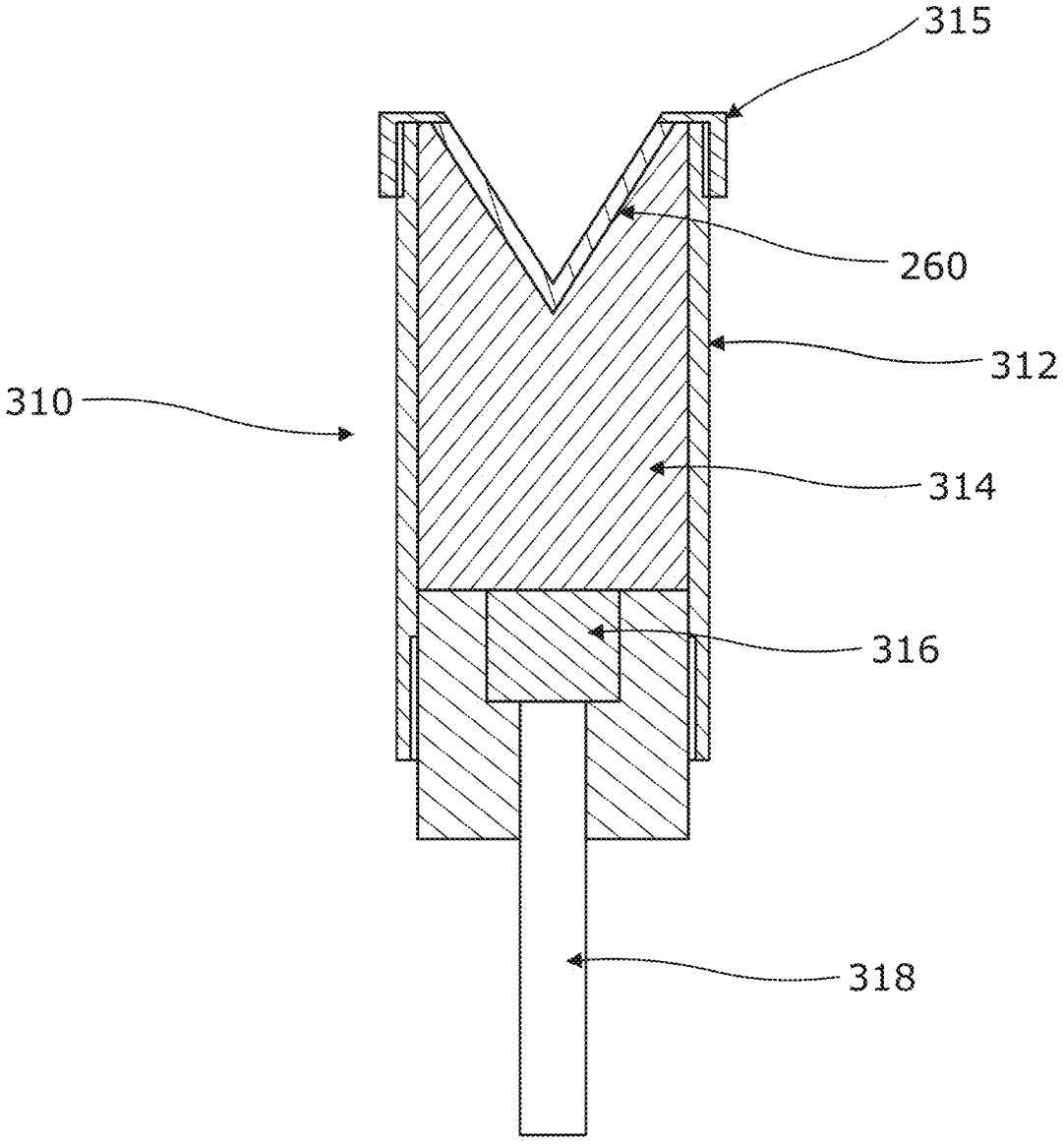
FIG. 10 shows a charge design in accordance with embodiments of the present invention.

Variants of the liner 260 depicted in FIG. 4 were then further tested using the in the laboratory tests using the charge design 310 shown in FIG. 10.

The charge design of FIG. 10 used in the laboratory tests comprised a steel charge holder 312 within which was held a main explosive charge of EDC 1(S) 314. One end 315 of the charge holder held the shaped charge liner under test. At the other end of the holder a booster pellet 316 (for initiating the main charge) was mounted so that it was in contact with (in communication with) the high/low voltage detonator 318.

Figure 11:
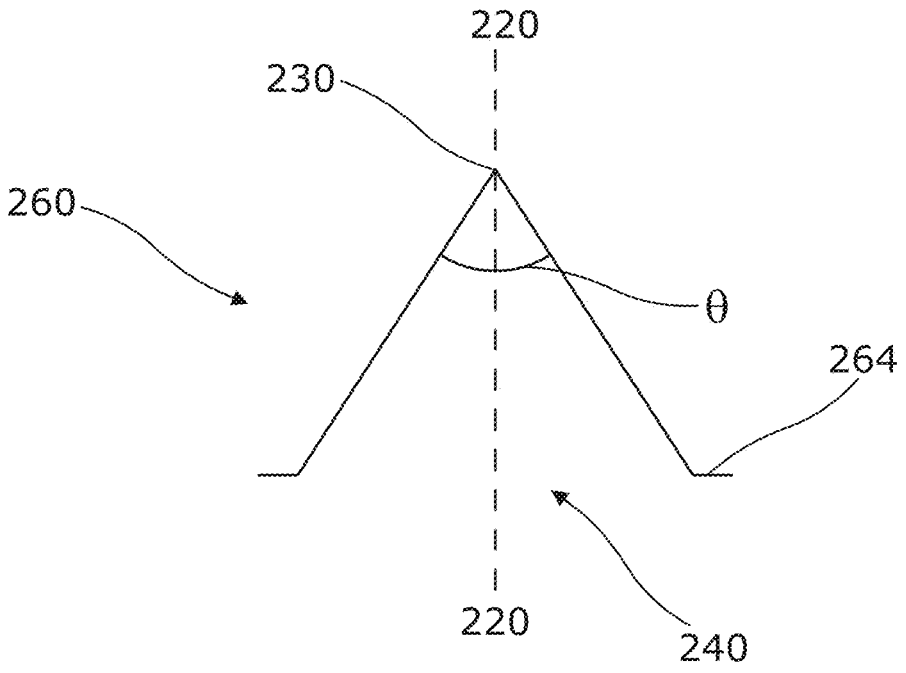
FIG. 11 shows a cross section through the liners of FIG. 4-6.

The further testing comprised changing the liner profile of the shaped charge liner of FIG. 4 slightly in order to "tune" the performance of the liner upon detonation. Two different liner profiles were tested. FIG. 11 shows a cross section through the liner 230 of FIG. 4. It is noted that an internal apex angle θ is defined by the prism sides of the liner. The first liner tested had an internal angle of 50° and the second liner tested had an internal angle of 60° although the skilled person w ill appreciate that other angles could be used. A similar cross section would be apparent for the liners of FIGS. 5 and 6, having an apex angle θ.

Figure 12B:
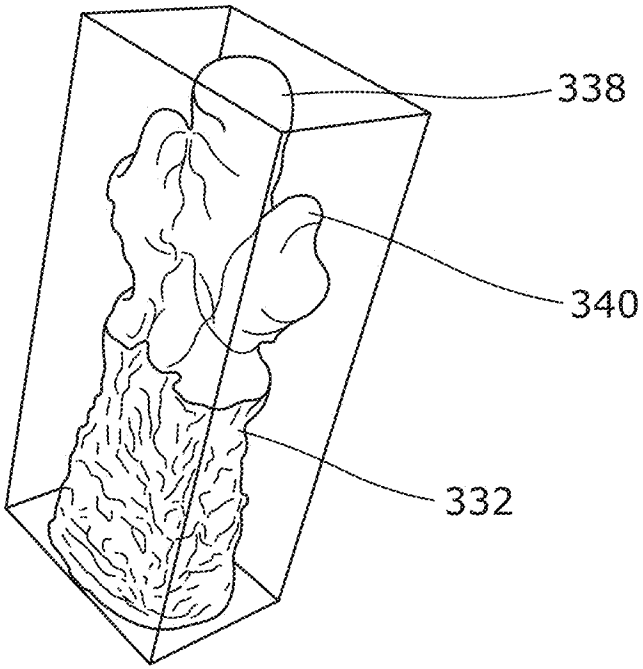
FIGS. 12*a* and 12*b* show simulated tunnel profiles for two liners with differing apex angles based on the design in FIG. 4 for 50° and 60° internal angles respectively.
Figure 12A:
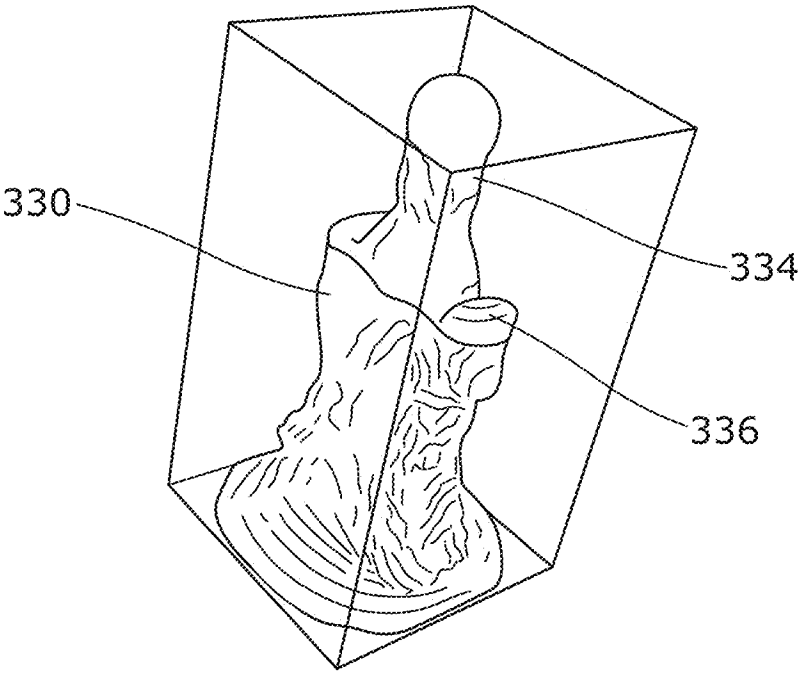

The simulated tunnel profiles 330, 332 for the two liners are shown in FIGS. 12*a* and 12*b*. FIG. 12*a* shows the predicted tunnel profile for the EDC1 filled design of shaped charge liner for a 50° internal apex angle and FIG. 12*b* shows the predicted tunnel profile for the shaped charge liner for a 60° internal apex angle. It can be seen that the changed apex angle results in a slightly different tunnel profile. In the case of FIG. 12*a* it can be seen that the primary tunnel 334 is more prominent compared to the offshoots 336. In FIG. 12*b* the primary tunnel 338 and offshoots 340 are of similar size.

Figure 13:
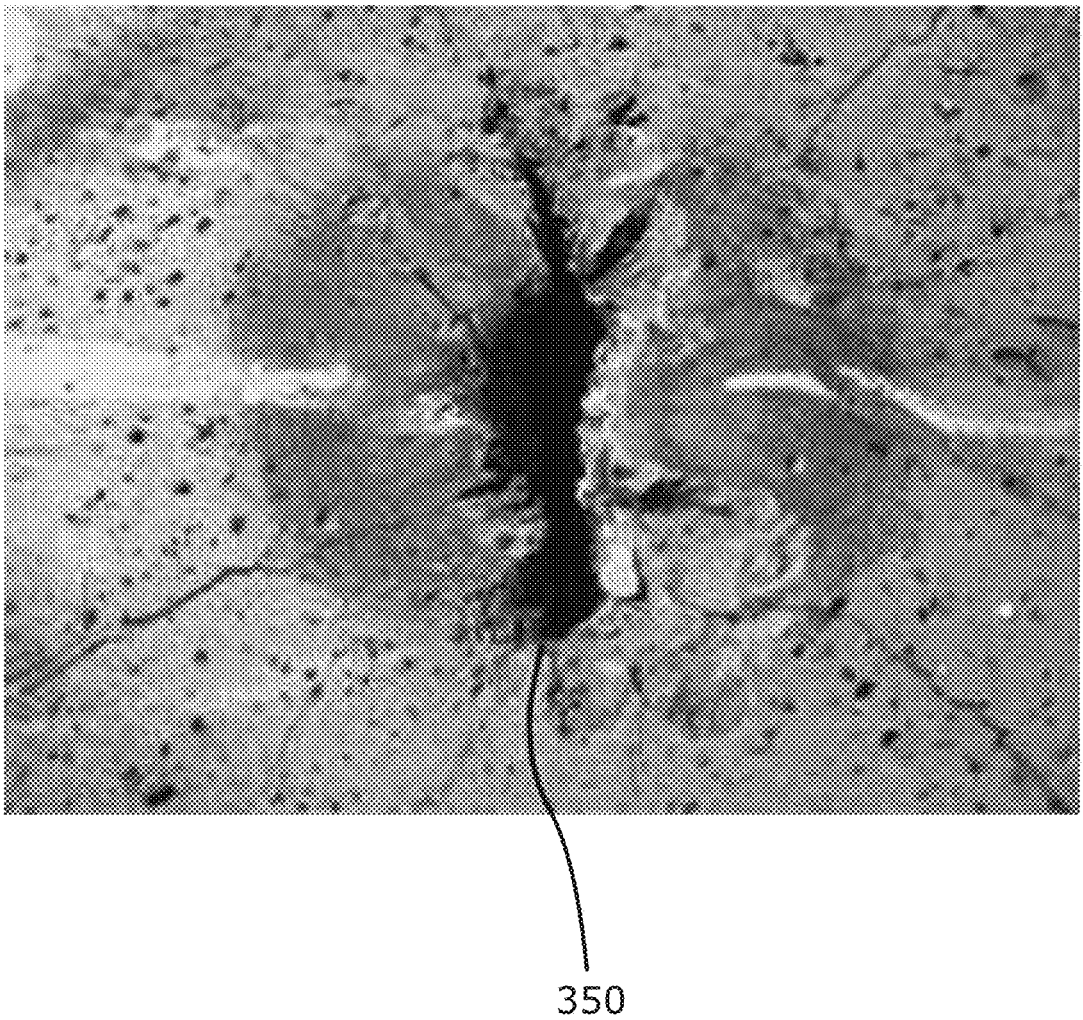
FIG. 13 shows a photograph of an incursion into a rock made by a liner in accordance with embodiments of the present invention.

The liner of FIG. 4 with an internal apex angle of 50° was fired into a target consistent with the arrangement of FIG. 3. A slot shaped tunnel 350 was created through the cement layer, through the well casing and with an initial incursion into the rock, as shown in the photograph of FIG. 13. The test firing was repeated with another liner of the same profile. Two further test firings were performed with a liner of the shape of FIG. 4 with an internal apex angle of 60°. The results of the various firings are shown below in Table 1 which show the hole dimensions in each part of the target.

TABLE 1

| Firing No | Round | Steel plate 202 (mm) | Cement 204 (mm) | Rock 206 (mm) |
|---|---|---|---|---|
| 1 | 50° (1) | 37 × 32 | 120 × 35 | Slight indent |
| 2 | 50° (2) | 35 × 32 | 135 × 38 | Slight indent |
| 3 | 60° (1) | 32 × 32 | 59 × 40 | 58 × 40 × 12 deep |
| 4 | 60° (2) | 33 × 30 | 72 × 38 | 53 × 26 × 12 deep |

As can be seen from Table 1 the liner trials demonstrate that slot holes can be produced with a prismatic liner 260 with varying internal apex angles. The results are reproducible and also demonstrate that varying the apex angle alters the size of the resultant hole. In the table the slot holes are provided either in the format X×Y (where X=width of slot hole and Y=height of hole) or in the format X×Y×Z (where the X×Y dimensions of the hole are specified at a distance Z beneath the surface of an object).

It is noted that the holes produced in the steel plate 202 are approximately 10 times larger in cross section than holes produced from an equivalent standard perforator charge which are generally 12.5 mm in diameter (as defined in the JRC Shaped Charge Listing performance handbook).

Figure 14A:
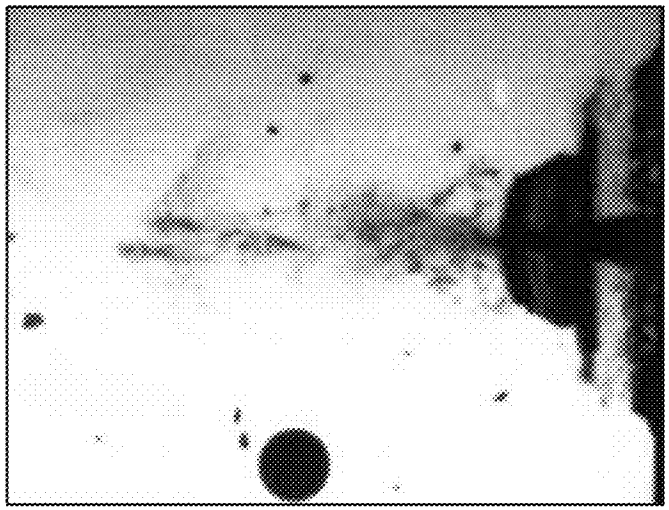
FIGS. 14*a* to 14*d* show results of measuring jet formation for two liners with differing apex angles over a pair of tests.
Figure 14B:
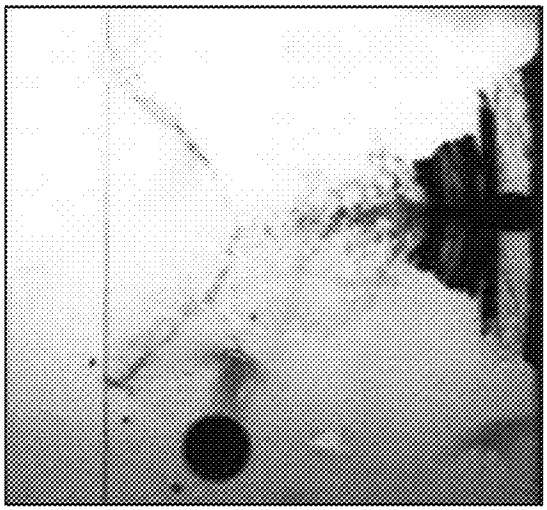
Figure 14C:
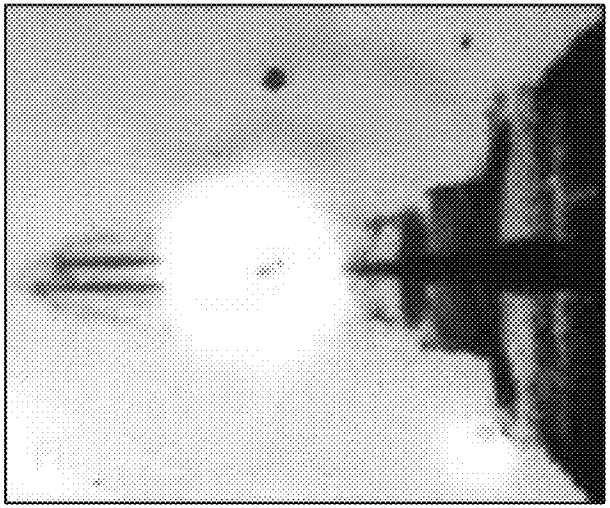
Figure 14D:
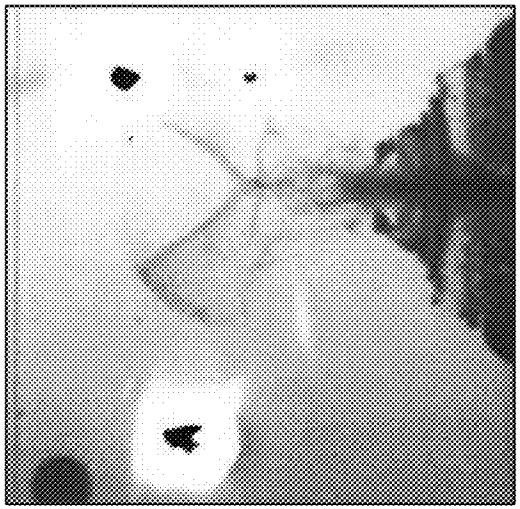
Figure 15A:
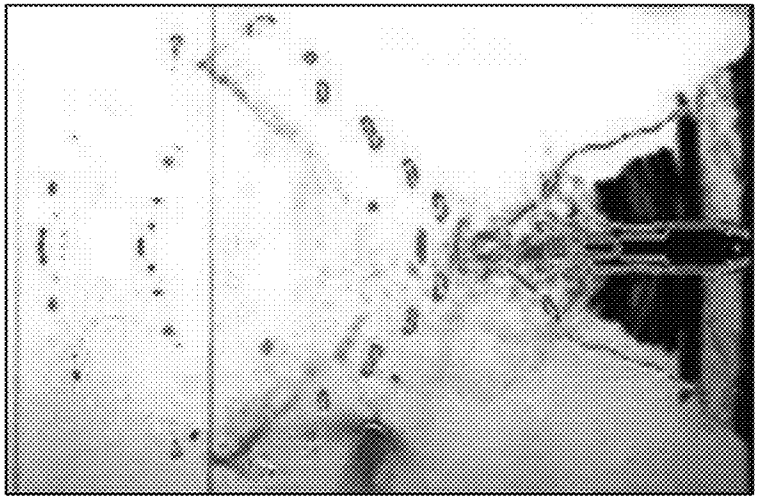
FIGS. 15*a* to 15*d* correspond to FIGS. 14*a* to 14*d* but show the results of modelling the same jet formations.
Figure 15B:
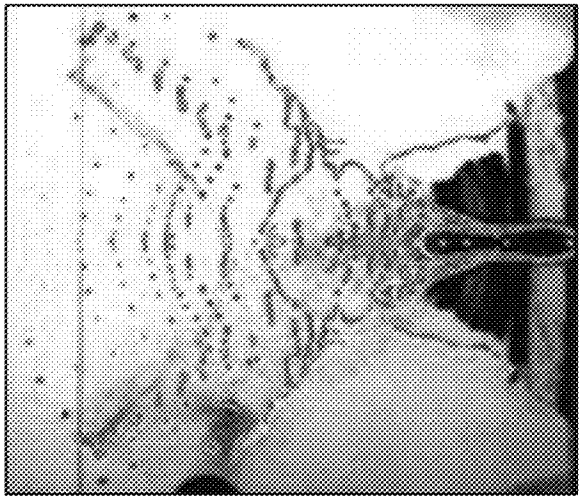
Figure 15C:
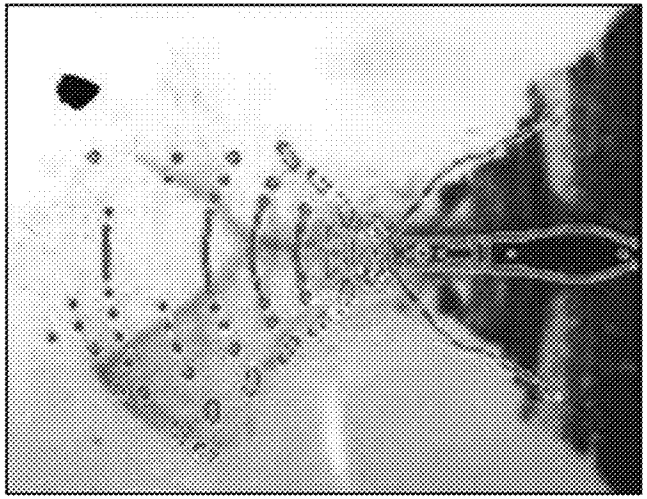
Figure 15D:
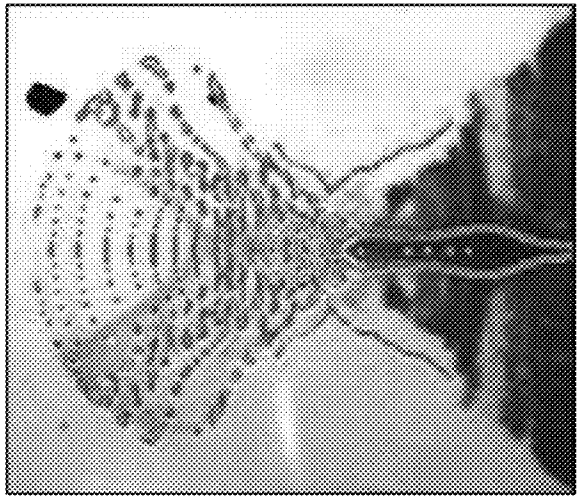

FIGS. 14*a* to 14*d* show the results of measuring the jet formation of the liners (firing rounds in Table 1) 1-4 tested above using a flash X-ray radiography set up. FIGS. 14*a* and 14*b* show orthogonal flash X-rays for the 50° liner design taken 25 μs after firing. FIGS. 14*c* and 14*d* show orthogonal flash X-rays for the 60° liner design taken 25 μs after firing.

It can be seen for the 50° design that there is little liner material between the 'V' shape of the jet, whereas for the 60° design there is evidence of thin bands of liner material between the 'V' shape. The jet for the 60° design also is more concentrated.

The X-rays all also show that the jet is a 'blade' shape in one plane and a narrow jet in the other plane and there is some evidence of the jet splitting. There is also a pronounced slug in the jet. The rounds were reproducible.

FIGS. 15*a* to 15*d* correspond to FIGS. 14*a* to 14*b* and additionally show the results of computer modelling of the shape of the jet formed from the 50° and 60° liners. It can be seen that there is a good correspondence between simulation and experiment.

FIGS. 3 to 15 show how, according to a first aspect of the present invention, the liner geometry can be customised such that desirable perforation tunnel geometric features are created, to order, within the well casing, cementation layer and rock strata. Such desirable features include (but are not limited to):

- tunnel geometries that will promote fracture initiation and propagation at minimal subsequent fracking pressures
- tunnel geometries that will promote fracture initiation and growth in a specific orientation in relation to the well casing and/or bedding planes.
- tunnel geometries that will promote maximum flow/flow rate from the rock through the cementation and well casing elements and into the well bore.

Tests (presented above) on the liner 260 variants depicted in FIG. 4 indicated the effects of changing the internal apex angle of the liner. It is noted that additionally, or alternatively, the liner or charge configuration may be varied to produce a designer hole. These are listed below and can be used to customise the hole produced by the charge.

- wrought metal, powder compact, reactive or non metallic (e.g. polymer based) liner material.
- Graded density liner using mixtures of materials or thin layers
- Liner shape
- Liner thickness variants (e.g. tapered, pointed apex, truncated liners)
- Varying initiation system (e.g. single, multi-point, wave-shaper, plane wave)
- Varying case material and shape
- Varying explosive composition According to a further aspect of the present invention there is provided a method of generating a library of shaped charge liners detailing the performance of such liners in different environmental conditions. According to a yet further aspect of the present invention there is provided a method of optimising a shaped charge liner design for use in an oil/gas well perforator to form a desired hole shape in a rock formation.

The process for this is flexible in being applicable to a whole range of well and gun dimensions and also different rock strata environments (e.g. horizontal, vertical bedding planes).

Figure 16A:
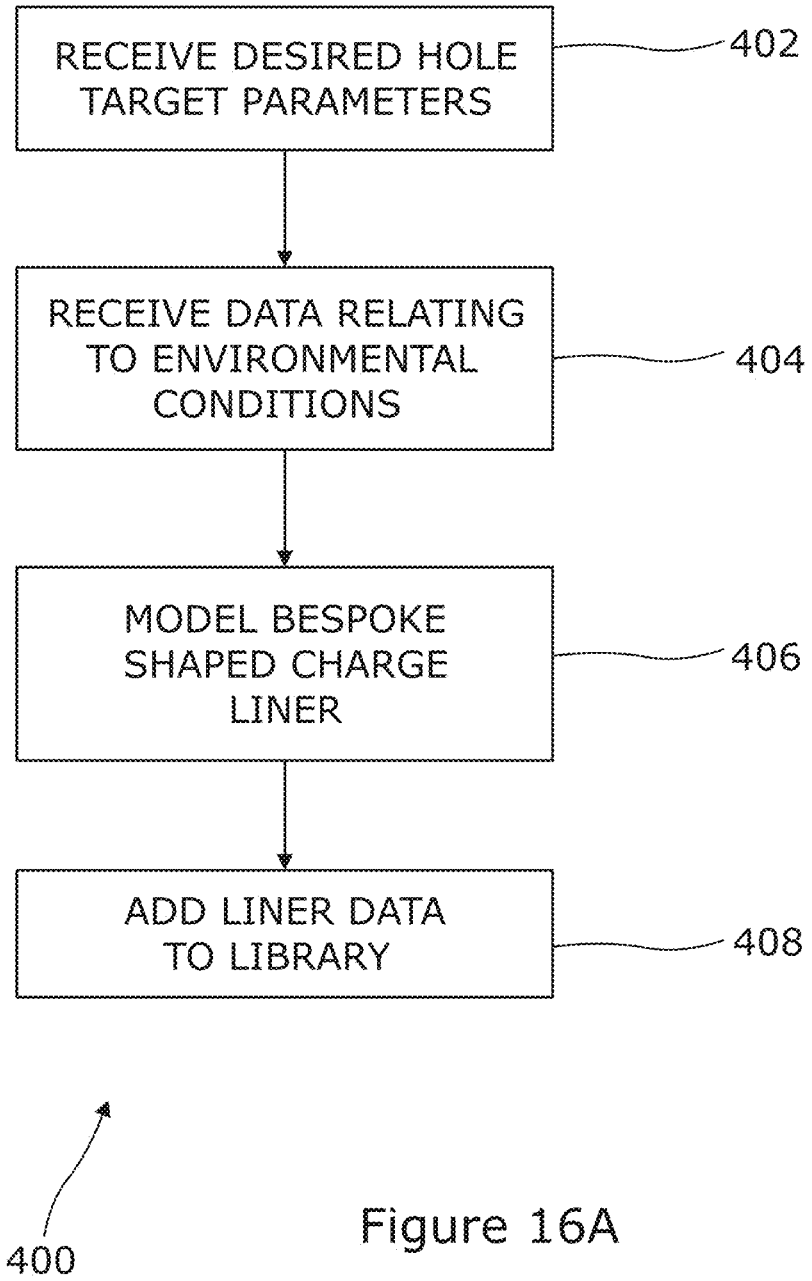
FIG. 16*a* shows a flow chart that details the process of generating a library of shape charge liners.

FIG. 16*a* is a flow chart 400 that details the process of generating a library of shape charge liners. So the process is to select or calculate the type of hole required for the given strata, gun dimensions, perforator geometrical constraints and well conditions (Step 402—receive desired hole "target" parameters and Step 404—receive environmental parameters). One would then develop a bespoke charge design (Step 406) to produce a 'designer hole' based on advanced simulation techniques. As experience is gained this would be expanded into a library of charge configurations/designs suitable for a range of wells that the completion engineer could select for a given application. This library would evolve (Step 408) to encompass more relevant situations encountered by the completion engineer. Additional simulations (e.g. using GRIM) would be performed to expand the library accordingly to account for the new range of well/gun conditions. These simulations would include investigation of liner parameters (e.g. materials, thickness, profile) and also case parameters (e.g. materials, thickness, profile). Also further laboratory experiments may be performed to prove certain designs configurations.

Figure 16B:
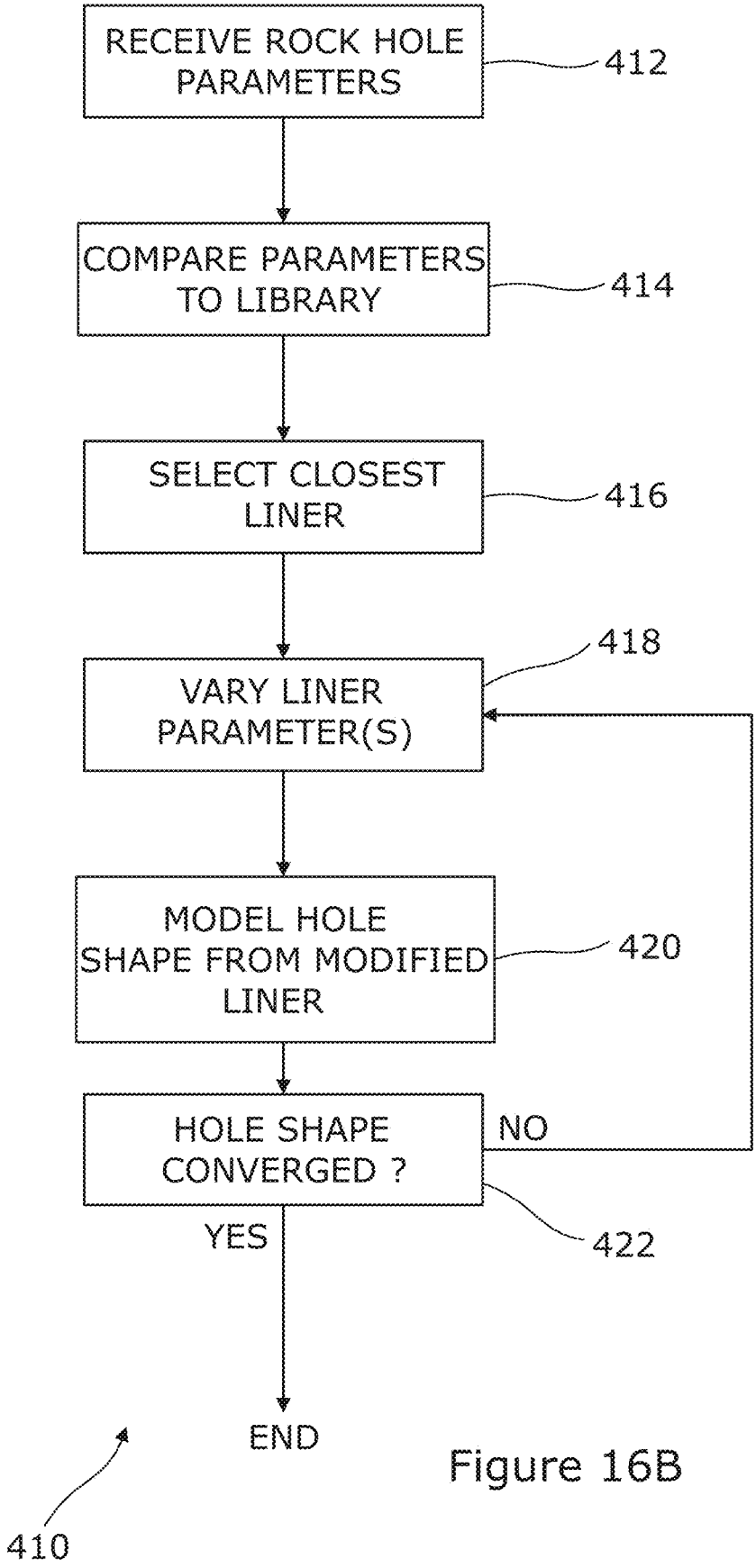
FIG. 16*b* shows a flow chart that relates to the process of liner/charge optimisation.

FIG. 16*b* is a flow chart 410 that relates to the process of liner/charge optimisation.

An example of the data contained in such a library is shown in FIG. 17. It can be seen that four different liner types, A-D, are characterised (there may be, for example, prismatic, star shaped, pyramid, hexagonal liners). For each liner type the performance of different rock types (R1, R2, R3, R4) is detailed and the data on the hole produced includes the type of cross section and the depth that the jet produced by the liner penetrates into the rock around the oil well. This would also be repeated for a range of gun and well dimensions. It should be noted that it is unlikely that the charges can simply be scaled from one gun/well condition to another.

The library may additionally include data on the effect of different liner materials on the performance of such liners (in which case each of the entries against each liner type in FIG. 17 would be repeated for each potential liner material).

It is noted that the data associated with the "liner type" would define the standard dimensions and relevant internal angles of each liner type.

Returning to the optimisation method shown in FIG. 16*b*, in Step 412, parameters relating to a desired hole to be formed in the rock adjacent to an oil/gas well are received. Such parameters may comprise the required hole depth and the general hole profile required (e.g. "slot like" cross section).

In Step 414 the received hole parameters are compared to the data contained within the library. It is noted that the performance of each liner within the library may be characterised for different rock types (e.g. sandstone, granite etc) and gun geometry, well conditions and additional constraints. The comparison of Step 414 would include filtering the data contained in the library to relate to the correct environment including rock type and strata conditions (i.e. the rock type that corresponds to the intended rock type that an oil/gas well is located in).

In Step 416, the shaped charge liner within the library that results in a hole that is closest to the desired hole shape is chosen.

In Step 418 a parameter relating to the selected liner is varied. This parameter may be the liner material, the liner thickness, the depth of the liner (or the internal apex angle) or any other relevant parameter.

In Step 420, the performance of the modified liner is modelled. Examples of suitable modelling methods comprise the GRIM hydrocode package.

In Step 422 the hole produced by the modified liner design is compared again to the desired hole profile. Steps 418 and 420 may then be repeated until the liner performance shows no further improvement (or until the liner performance shows no appreciable improvement). In other words the optimisation method checks whether the modified liner performance has converged towards the desired hole shape. The resultant shaped charge liner design represents an optimised design that is suitable for use in the particular down-well environment that relates to the desired hole shape.

Further variations and modifications not explicitly described above may also be contemplated without departing from the scope of the invention as defined in the appended claims.

The invention claimed is:

1. A shaped charge liner for use with a separate and non-unitary charge case, the shaped charge liner comprising:

- a cylindrically shaped lip member that is configured to engage the charge case, one end of the lip member defining a planar face having a diameter and an opposite end of the lip member defining a bottom face, a concavity extending between the planar and bottom faces of the lip member; and a projecting section defined by side walls projecting from the planar face of the lip member to define a linear apex end at a location that is spaced furthest from the planar face in a direction along a main liner axis that passes through the apex end and the lip member, the side walls having both inner surfaces and outer surfaces, wherein a maximum width of the outer surfaces at an end of the projecting section opposite the apex end extends in a direction perpendicular to the main liner axis and is less than the diameter of the planar face of the lip member such that flat surfaces are defined on the planar face of the lip member between all portions of the end of the projecting section and an outer perimeter of the lip member, the projecting section being rotationally symmetrical about the main liner axis such that the projecting section has discrete rotational symmetry about the main liner axis, a cross-section of the projecting section in a plane perpendicular to the main liner axis defining an obround shape.

2. The liner as claimed in claim 1, wherein the planar face of the lip member is circular, and wherein the side walls of the projecting section include opposing half cones that define two opposing walls each of which is arcuate in cross-section.

3. The liner as claimed in claim 1, wherein the concavity of the lip member is contiguous with an aperture of the projecting section so as to form a single contiguous opening.

4. The liner as claimed in claim 3, wherein a width of the concavity of the lip member is wider than a width of the aperture of the projecting section in the direction perpendicular to the main liner axis.

5. The liner as claimed in claim 4, wherein the concavity of the lip member has a smaller volume than the aperture of the projecting section.

6. The liner as claimed in claim 1, wherein the liner is formed from a wrought metal.

7. The liner as claimed in claim 1, wherein the liner is formed from a pressed metal powder, and the metal powder includes tungsten powder.

8. The liner as claimed in claim 1, wherein the projecting section is hollow.

9. The liner as claimed in claim 1, wherein the liner constitutes a reactive liner.

10. The liner as claimed in claim 1, wherein the charge case defines a lower end, and the lip member engages a region of the charge case adjacent the lower end.

* * * * *